United States Patent [19]

Deutch

[11] 3,967,514

[45] July 6, 1976

[54] RATCHET WRENCH

[76] Inventor: Howard E. Deutch, 1216 Holy Cross, Monroeville, Pa. 15146

[22] Filed: Jan. 28, 1975

[21] Appl. No.: 544,798

[52] U.S. Cl. ..... 81/63
[51] Int. Cl.[2] ..... B25B 13/46
[58] Field of Search ..... 81/60–63.2

[56] References Cited

UNITED STATES PATENTS

| | | | |
|---|---|---|---|
| 460,474 | 9/1891 | Knapp et al. | 81/63 |
| 603,377 | 5/1898 | Fitch | 81/63 |
| 1,078,059 | 11/1913 | Mossberg | 81/63 |
| 3,273,429 | 9/1966 | De Orlow | 81/62 |

*Primary Examiner*—James L. Jones, Jr.
*Attorney, Agent, or Firm*—Fleit & Jacobson

[57] ABSTRACT

There is disclosed a ratchet wrench which can accommodate bolts having threaded portions which extend well beyond a nut and which are located in difficult to reach positions within mechanical equipment. The wrench has a long socket adapter for reaching such bolts. Adapter passageways extending through the socket, socket adapter and wrench handle provide a clearance opening to allow the wrench to accept bolts having threaded portions which extend well beyond a nut.

1 Claim, 3 Drawing Figures

RATCHET WRENCH

BACKGROUND

The present invention relates in general to hand tools and, more particularly, to a ratchet wrench which accommodates bolts having long threaded portions.

A ratchet wrench utilizes a pawl and ratchet gear for transmitting a driving force to a bolthead or nut via a socket. The wrench transmits driving force when rotated in one direction but allows slippage upon rotation in the opposite direction. Anyone involved in installation or service of mechanical equipment usually has a large variety of ratchet wrenches in his toolbox. It is expensive, however, to have a large variety of wrenches which perform basically identical functions, yet installation and service personnel are required to have such a large variety of wrenches, including ratchet wrenches, because mechanical designers are often forced to use a large variety of bolts and fastening devices on a single piece of equipment. The various nuts and bolts used in such equipment may have different nut and bolthead configurations, therefore sockets associated with a single ratchet wrench often must have correspondingly wide variation in configurations. Furthermore, there are many instances when mechanical equipment contains nuts and bolts in positions which are not easily accessible due to surrounding equipment. One solution to the problem of bolt inaccessibility is to provide a long adapter for mounting the socket on the wrench handle. The adapter can extend into otherwise inaccessible areas to reach nuts or boltheads located in such positions.

Therefore, a socket set often includes a ratchet wrench and a number of sockets each designed to accept a nut or bolt having a different size or configuration. Many socket sets also include a handle having a long socket adapter for reaching nuts or boltheads located in difficult areas. The sockets are attached to the ratchet wrench by inserting the metal extension or socket adapter of the ratchet wrench into an opening in the socket. So long as only boltheads or nuts attached to very short bolts are inserted into the socket they can be tightened or loosened using a socket on such an extension. However, if one attempts to tighten a nut to the point that a great length of the threaded bolt, for example more than ⅜ inch, extends into the socket, the socket will reject the nut. If one attempts to loosen a nut which is positioned on such a long bolt, the socket will likewise not accept the nut. The reason for this is that the metal extension of the ratchet wrench will come into contact with the bolt and, since the distance between the contact point and the outer edge of the socket is usually about ⅜ inch, a nut which is more than ⅜ inch from the end of the bolt will not be engaged by the socket.

Deep socket sets represent one solution to the problem associated with long bolts and often accept bolts having longer threaded portions, for instance up to ½ inch extension beyond the nut. However, mechanical equipment may comprise bolt shanks which extend ½ inch beyond the nut and thus, even these so-called deep socket sets will not adequately engage the nut. Furthermore, it is expensive to maintain a socket set having a complete set of sockets for each of several bolt lengths.

To accommodate bolts having threaded portions extending well beyond a nut, other socket sets include sockets mounted in a cavity in the wrench handle and having an inner bore which forms a passageway through the socket. However, nuts or boltheads located deep inside mechanical equipment cannot be reached by these socket sets as none has a socket adapter for reaching such nuts or boltheads.

Therefore, known ratchet wrenches or socket sets are not suitable for accommodating bolts having threaded sections which extend well beyond a nut and which are also located in a position which can only be reached by providing the wrench with an extended socket adapter. The present invention provides a ratchet wrench which overcomes these shortcomings and can perform wrenching operations on nuts associated with bolts that have threaded portions extending well beyond a nut and that are also located in areas of mechanical equipment which are ordinarily inaccessible to known wrenches or socket sets.

BRIEF SUMMARY OF THE INVENTION

Briefly, the ratchet wrench of the present invention comprises an extension or socket adapter which allows the device to perform wrenching operations on nuts or boltheads located in otherwise inaccessible areas and which also accepts nuts positioned on bolts having long threaded portions extending beyond the nut. The extension or socket adapter has an axial passageway extending completely through it and accommodates sockets also having axial passageways extending completely through them. The socket passageway aligns with the adapter passageway to allow bolt threaded portions to extend through the socket and into the adapter passageway. The adapter is mounted on the ratchet wrench handle and has a passageway which extends completely through the wrench handle so that, if necessary, the threaded portion of the bolt can pass completely through the adapter and extend through the wrench handle. Thus, bolts having threaded portions extending for any length beyond a nut can be accommodated by the wrench of the present invention.

It is accordingly a broad object of the present invention to provide a ratchet wrench which can accommodate bolts having threaded portions extending well beyond a nut.

It is a further object of the present invention to provide a ratchet wrench which can perform wrenching operations on nuts located in difficult to reach areas of mechanical equipment.

It is yet another object of the present invention to provide a ratchet wrench requiring only a single socket length for accommodating all bolts.

These and other objects of the present invention, as well as many attendant advantages thereof, will become more readily apparent when reference is made to the following description taken in conjunction with the accompanying drawings.

DESCRIPTION OF THE PREFERRED EMBODIMENT

Figure 1:
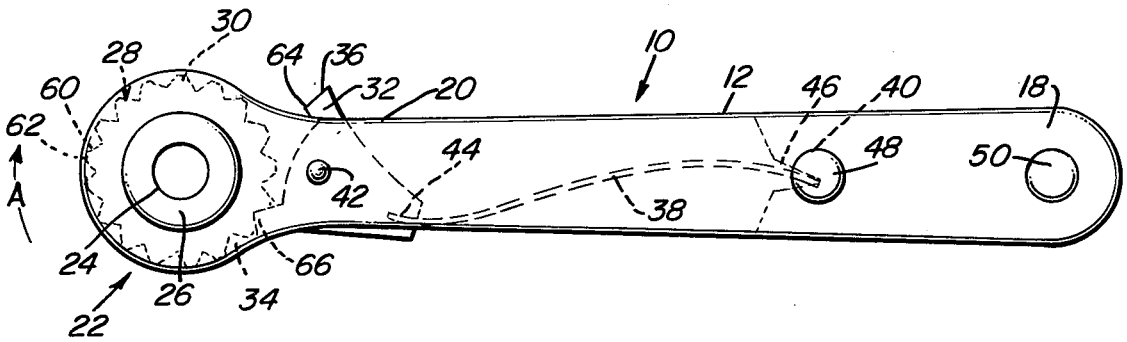
FIG. 1 is a plan view of a ratchet wrench designed in accordance with the teachings of the present invention.
Figure 2:
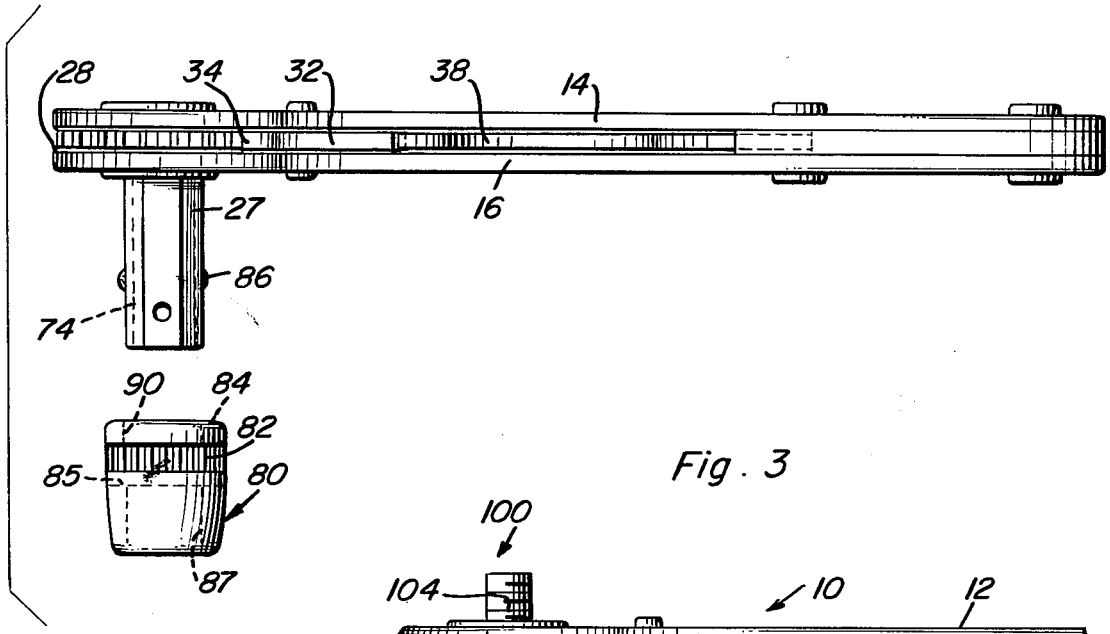
FIG. 2 is an elevation view of a socket along with the wrench shown in FIG. 1.

Shown in FIGS. 1 and 2 is a preferred form of the ratchet wrench 10 constructed in accordance with this invention. A handle 12 comprises two similar plates 14 and 16, each having corresponding shapes which are tapered into three segments, wherein the transverse dimension of a gripping segment 18 exceeds the transverse dimension of a neck segment 20. A generally circular head segment 22 is positioned on the terminus of handle 12 adjacent neck segment 20 and opposite the gripping segment 18. Head segment 22 contains a circular hole 24 for accommodating an adapter or boss for flange 26 of a socket adapter 27 which flange engages head segment 22 for mounting the socket adapter 27 in hole 24.

A ratchet mechanism 28 has ratchet teeth 30 which engage pawl 32 having engaging surfaces 34 and 36 and biased in position by flat spring 38 attached to spring base 40. Ratchet mechanism 28 is fixedly attached to adapter flange 26 and the two will thus move or rotate in unison. A rivet 42 holds pawl 32 in neck segment 20 and spring 38 is attached at one end to pawl 32 in spring seat 44 and at the other end to spring seat 46 in spring base 40. Rivets 48 and 50 hold spring base 40 in position and, along with rivet 42 and flange 26, hold plates 14 and 16 together to form handle 12.

The ratchet gear teeth 30 are in the form of obelisks or frustums of rectangular pyramids and have sloping surfaces 60 and flat faces 62. The engaging surfaces 34 and 36 of pawl 32 are shaped to correspond to the sloping surfaces 60 and engage the gear mechanism to allow movement in but a single direction. Bevelled edges 64 and clearance spaces 66 allow the ratchet gear to turn in the desired direction. When the pawl is in the position shown in FIG. 1, having pawl engaging surface 34 abutting gear teeth 30, ratchet mechanism 28 will turn in the direction indicated by arrow "A". When the pawl is shifted against the bias of flat spring 38 to the opposite position wherein engaging surface 36 abuts ratchet teeth 30, the direction of mechanism movement is opposite to that shown by arrow "A".

Socket adapter 27 has an inner bore or passageway 74 extending axially through the adapter. Passageway 74 is axially aligned relative to head segment hole 24 so that upon engagement of adapter 27 into hole 24 by flange 26, a continuous central passageway is formed which extends from the end of adapter 27 which is farthest from handle 12 completely through the adapter and the handle. The inner passageway 74 can be of any suitable shape, such as the hexagonal shape shown in FIG. 1 or circular or whatever may be desired to assure the proper clearance and rigidity to the adapter. The adapter 27 allows wrench 10 to perform wrenching operations on nuts or boltheads located deep inside mechanical equipment which would otherwise be inaccessible except by removing surrounding equipment. The aligned passageway allows the wrench to accept nuts positioned on bolts having long threaded portions which would otherwise be rejected by a wrench not having such a passageway. Therefore, the aligned passageway through the adapter and wrench handle allows one socket set to accommodate the wide variety of bolt and bolt locations found in modern mechanical equipment. The adapter 27 can be any suitable length, and, if desired, the wrench can be constructed to allow interchanging of adapters having a variety of lengths.

A socket 80 having knurling 82 and axial passageway 84 is in form engagement with adapter 27 and held in place by detents 86. Form engagement as used herein implies that the engaging members have corresponding polygonal shapes, wherein relative movement between the two members in the direction of rotation is prevented. Passageway 84 of the socket is divided into two axially contiguous sections, having a shoulder 85 therebetween. A first nut engaging section 87 is in form engagement with a nut 88 and a second adapter engaging section 90 is in form engagement with the outer perimeter of socket adapter 27 between detents 86 and the end of the adapter. The shapes of sections 87 and 90 are determined according to the shape of nut 88 and the outer perimeter of adapter 27 respectively. Socket passageway 84 aligns with adapter passageway 74 when the socket is mounted on the adapter. Thus, a bolt threaded portion will pass through socket 80 when the socket is engaged about the nut thereon. Because the bolt threaded section can pass completely through the socket, a single length socket can accommodate bolts having any length extension beyond the nut. Thus, a socket set having sockets of only a single length is still complete and can accommodate a wide variety of bolts.

Figure 3:
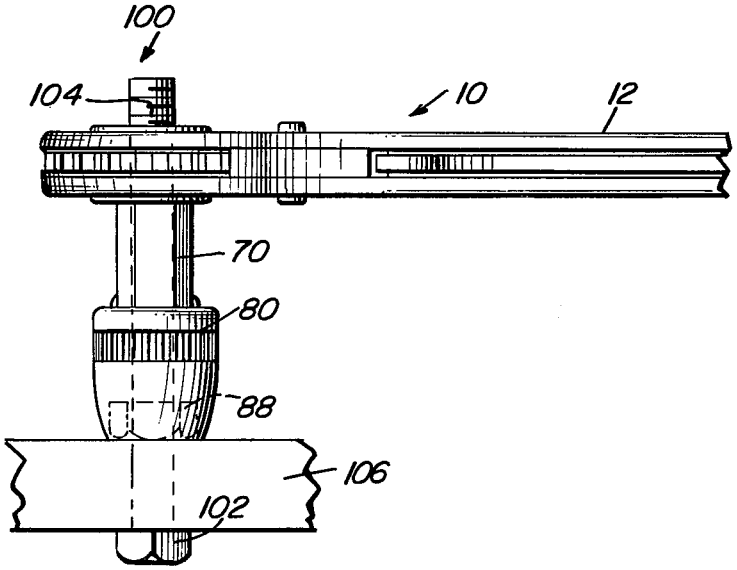
FIG. 3 shows the wrench designed in accordance with the teachings of the present invention in engagement with a nut and bolt combination.

As shown in FIG. 3, a nut 88 threadably attaches a bolt 100 having a bolthead 102 and a long threaded portion 104 extends into passageways 84 and 74. Thus, bolts located in difficult to reach areas and also having extremely long threaded portions extending beyond nut 88 can be accommodated by wrench 10 without obstructing the operation of either the wrench or the wrenching operation itself. Without passageways 84 and 74, such bolts could not be accommodated by the wrench and it would be impossible for the socket to engage nut 88. Once the socket and adapter are properly engaged, pawl 32 is set and the wrench rotated to move ratchet mechanism 28 and hence adapter 27 in the desired direction. The movement of adapter 27 is transmitted to nut 88 by socket 80 to move nut 88 in the desired direction.

Obviously, numerous modifications and variations of the present invention are possible in the light of the above teachings. It is therefore understood that, within the scope of the appended claims, the invention may be practiced otherwise than as specifically described.

I claim:

1. A ratchet wrench comprising, in combination, a pair of substantially identical, flat plates disposed in spaced-apart, overlying, aligned relationship to define a gap therebetween, said plates having opposite end portions forming a gripping segment and a head segment respectively and a neck segment intermediate said head segment and said gripping segment to form a handle, a flat plate member disposed within said gap in sandwiched relationship with said plates and extending throughout said gripping segment, said plate member being provided with a recess at the end adjacent said neck segment, a plurality of longitudinally spaced rivets in said gripping segment extending vertically through said plates and said plate member, said plates having a pair of vertically aligned openings in said head segment, an elongated, tubular adapter having a central bore and an upper end portion extending through said head segment openings with said adapter central bore in coaxial relationship with said openings to form a continuous passage, at least one annular flange on said adapter upper end portion for sliding engagement with one of the plates of said head segment to permit rotation of said adapter relative to said head segment, a ratchet gear having teeth mounted on said adapter upper end portion and disposed within said gap between said plates within said head segment, a plurality of sockets each having a central bore provided at one end with a portion for engaging a nut of a selected size, and an adapter engaging portion at the other end, said adapter having a lower end portion of a cross-sectional shape for accommodation within the adapter engaging portion of each of said sockets selectively with said socket central bore in axial alignment with said adapter central bore to form a continuous passage through said socket, said adaptor and said openings in said head segment thereby accommodating a bolt on which a nut engaged by said socket is mounted, a pawl disposed within said gap at the end of said neck segment opposite said plate member in sandwiched relationship with said plates for pivotal movement within said gap and having one side portion extending within said neck segment, a rivet extending vertically through said plates and said pawl for supporting said pawl for said pivotal movement, said pawl one side portion being provided with a recess, the other side portion of said pawl adjacent said head segment being provided with a pair of spaced-apart teeth engaging surfaces, a substantially S-shaped leaf spring disposed within said gap along said neck portion having opposite ends accommodated with said pawl recess and said plate member recess respectively for yieldingly urging said pawl pivotally in one direction to engage one of said engaging surfaces with said ratchet gear teeth for rotation of said ratchet gear together with said adapter and socket mounted thereon in one direction during the movement of said handle in one direction, the said pawl being pivotally movable by said ratchet gear teeth against the urging force of said spring to engage the other of said engaging surfaces on said pawl with said ratchet gear teeth for rotation of said ratchet gear together with said adapter and socket mounted thereon in the opposite direction during the movement of said handle in the opposite direction.

* * * * *